US008770798B2

(12) United States Patent
Matsuda et al.

(10) Patent No.: US 8,770,798 B2
(45) Date of Patent: Jul. 8, 2014

(54) LUMINAIRE

(71) Applicant: Toshiba Lighting & Technology Corporation, Kanagawa (JP)

(72) Inventors: Ryotaro Matsuda, Kanagawa (JP); Yumi Hanyuda, Kanagawa (JP); Takayoshi Moriyama, Kanagawa (JP); Yoshiro Oka, Kanagawa (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/754,531

(22) Filed: Jan. 30, 2013

(65) Prior Publication Data

US 2014/0111986 A1 Apr. 24, 2014

(30) Foreign Application Priority Data

Oct. 19, 2012 (JP) ..... 2012-231857

(51) Int. Cl.
*F21V 29/00* (2006.01)

(52) U.S. Cl.
USPC ..... 362/294; 313/45

(58) Field of Classification Search
USPC ..... 362/294, 241, 243, 247, 341, 345, 346; 257/98; 313/45, 46
See application file for complete search history.

(56) References Cited

U.S. PATENT DOCUMENTS

| | | | | |
|---|---|---|---|---|
| 2,364,707 | A * | 12/1944 | Glover | 362/1 |
| 4,219,232 | A * | 8/1980 | Kouth | 296/223 |
| 5,113,330 | A * | 5/1992 | Makita | 362/265 |
| 7,140,733 | B2 * | 11/2006 | Takezawa et al. | 353/52 |
| 8,070,328 | B1 * | 12/2011 | Knoble et al. | 362/311.02 |
| RE43,777 | E * | 10/2012 | Fujimori et al. | 353/55 |
| 2002/0064046 | A1 * | 5/2002 | Davis et al. | 362/298 |
| 2002/0159262 | A1 * | 10/2002 | Romano et al. | 362/345 |
| 2006/0034084 | A1 * | 2/2006 | Matsuura et al. | 362/293 |
| 2008/0112168 | A1 | 5/2008 | Pickard et al. | |
| 2008/0117637 | A1 * | 5/2008 | Chang et al. | 362/294 |
| 2010/0038657 | A1 | 2/2010 | Higuchi et al. | |
| 2010/0259919 | A1 | 10/2010 | Khazi et al. | |
| 2011/0267828 | A1 | 11/2011 | Bazydola et al. | |
| 2013/0141918 | A1 * | 6/2013 | Harbers et al. | 362/294 |

FOREIGN PATENT DOCUMENTS

| | | | |
|---|---|---|---|
| JP | 2012-009280 | | 1/2012 |
| WO | 2011104258 | A2 | 9/2011 |
| WO | 2011131198 | A1 | 10/2011 |
| WO | 2011162323 | A1 | 12/2011 |

OTHER PUBLICATIONS

European Search Report dated Jan. 17, 2014 for Application No. 13 15 1179.

* cited by examiner

*Primary Examiner* — Nimeshkumar Patel
*Assistant Examiner* — Glenn Zimmerman
(74) *Attorney, Agent, or Firm* — Patterson + Sheridan LLP

(57) ABSTRACT

According to one embodiment, a floodlight includes at least one light-emitting part, a thermal radiator, a reflector, and an adapter part attachable to and detachable from the thermal radiator. The light-emitting part includes an LED element. The thermal radiator is thermally connected to the light-emitting part. The reflector is provided on the thermal radiator, and controls luminous intensity distribution from the light-emitting part. The adapter part includes an extension reflector. The extension reflector is continuous with the reflector in a state where the adapter part is attached to the thermal radiator and, together with the reflector, controls the luminous intensity distribution from the light-emitting part to provide a luminous intensity distribution angle narrower than the reflector.

16 Claims, 7 Drawing Sheets

LUMINAIRE

INCORPORATION BY REFERENCE

The present invention claims priority under 35 U.S.C. §119 to Japanese Patent Application No. 2012-231857 filed on Oct. 19, 2012. The content of the application is incorporated herein by reference in their entirety.

FIELD

Embodiments described herein relate generally to a luminaire used as, for example, a floodlight.

BACKGROUND

Hitherto, there is a high output luminaire which is used as a floodlight for illuminating, for example, a signboard or for providing stage illumination of a building, or as a spotlight. In recent years, as such a luminaire, there is one including an LED (light-emitting diode) of a solid light-emitting element as an illuminant in order to prolong life, to save energy, to reduce weight or to reduce size. The LED floodlight as stated above is often designed such that many surface mount LEDs and optical lenses are arranged. However, as the output increases, the number of LEDs and lenses increases, and the cost, weight and equipment area increase. Besides, since the LED has high emission luminance, if the number of light sources is large, an afterimage is liable to remain in eyes, and glare is caused. Then, in order to solve the problem of the plural light sources while using the LED light source modules mounted at high density, a structure is known which includes LEDs and a reflector to control the luminous intensity distribution from the LEDs.

DETAILED DESCRIPTION

Figure 1:
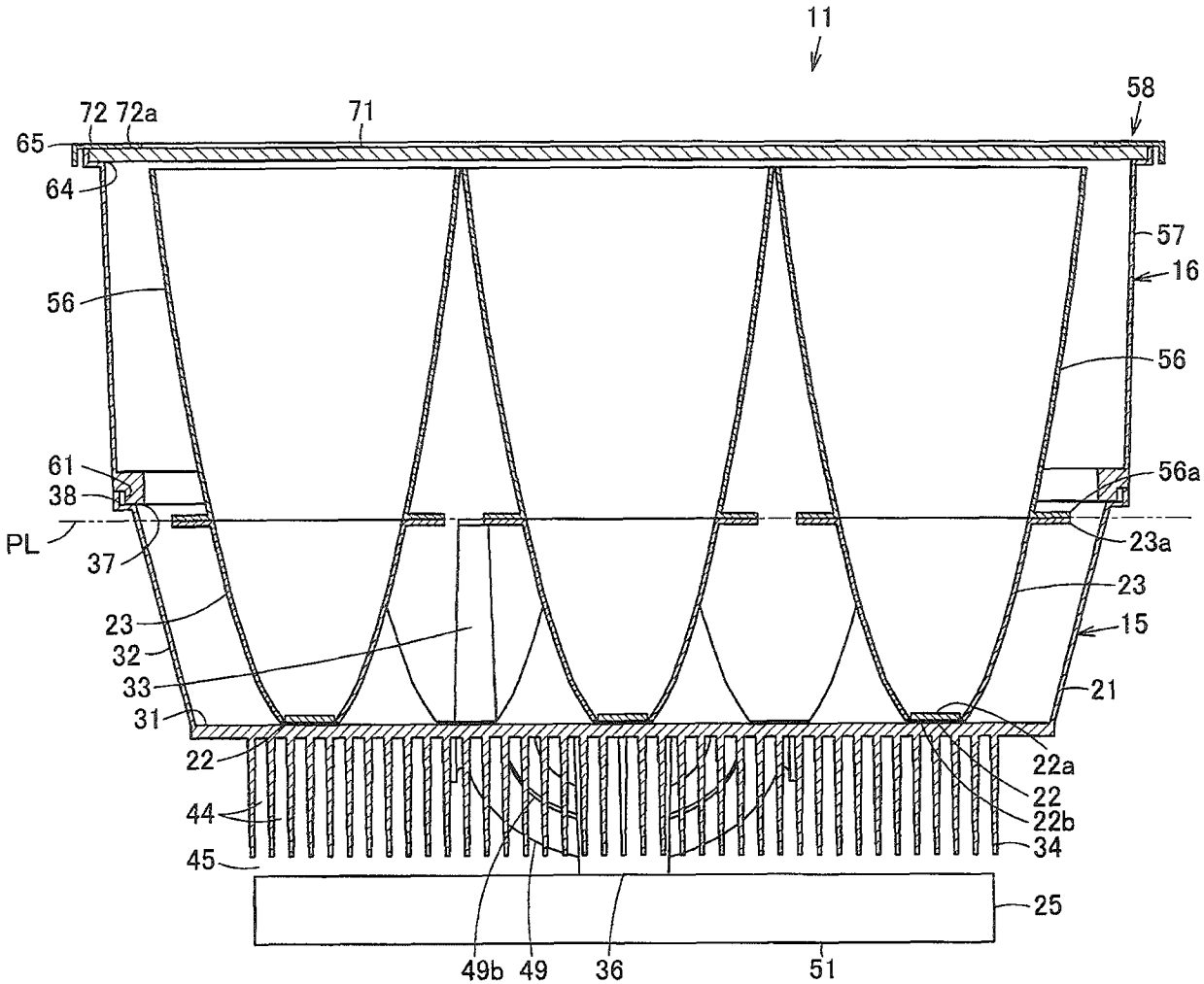
FIG. 1 is an I-I sectional view of FIG. 5 showing a luminaire of an embodiment.

In general, according to one embodiment, a luminaire includes at least one light-emitting part, a thermal radiator, a reflector, and an adapter part attachable to and detachable from the thermal radiator. The light-emitting part includes a solid light-emitting element. The thermal radiator is thermally connected to the light-emitting part. The reflector is provided on the thermal radiator, and controls luminous intensity distribution from the light-emitting part. The adapter part includes an extension reflector. The extension reflector is continuous with the reflector in a state where the adapter part is attached to the thermal radiator and, together with the reflector, controls the luminous intensity distribution from the light-emitting part to provide a luminous intensity distribution angle narrower than the reflector.

Hereinafter, a structure according to an embodiment will be described with reference to FIG. 1 to FIG. 7.

In FIG. 1 to FIG. 7, reference numeral 11 denotes a floodlight as a luminaire, and the floodlight 11 is for irradiating light to an irradiation object such as, for example, various signboards or a building and has a high power of, for example, 1 kW class. Incidentally, hereinafter, a front and rear direction is set relative to an optical axis direction (irradiation direction).

The floodlight 11 includes a common main body part 15 and an adapter part 16 attachable to and detachable from the common main body part 15.

The common main body part 15 includes a thermal radiator 21 as a housing of an equipment main body, at least one, in this embodiment, for example, seven light-emitting parts 22 arranged on the thermal radiator 21, plural reflectors 23 corresponding to the light-emitting parts 22 and attachably and detachably attached to the thermal radiator 21, an attachment arm 24 as an attachment member to attach the thermal radiator 21 to a not-shown attachment target part such as a construction, and a power supply part 25 to supply power to the light-emitting parts 22. A cover part 26 is attached to the thermal radiator 21, so that the common main body part 15 functions as a first floodlight (floodlight for middle or wide angle) capable of providing middle angle or wide angle luminous intensity distribution of a first luminous intensity distribution angle.

The thermal radiator 21 is integrally formed of a light weight member with an excellent thermal radiation property, such as, for example, an aluminum or aluminum die-casting member, and includes a bottom part 31 having, for example, a hexagonal shape, a side wall part 32 standing from the periphery of the bottom part 31 toward the front side, a boss part 33 as a fixing part provided to protrude on the bottom part 31, and many thermal radiation fins 34 provided on the back side of the bottom part 31.

The bottom part 31 is formed in a flat plate shape, and the light-emitting part 22 is attached and is thermally connected thereto. Besides, in the bottom part 31, a wiring hole 35 for wiring a not-shown power supply line to electrically connect the power supply part 25 and the light-emitting part 22 is opened at a position close to the lower side. A wiring boss part 36 is integrally formed on the back side of the wiring hole 35, that is, the rear side of the bottom part 31. The wiring boss part 36 protrudes on the back side of the bottom part 31 more than the thermal radiation fins 34, and is coupled to the power supply part 25.

The side wall part 32 is formed like a wall continuous over the whole circumference of the bottom part 31, includes, for example, six side parts 32*a*, and surrounds the whole periphery of the reflector 23 like a frame. Further, the side wall part 32 is formed in a longer shape in the optical axial direction than the reflector 23. Accordingly, the front end part of the side wall part 32 (thermal radiator 21) is positioned in front of the front end part of the reflector 23. Besides, the side wall part 32 is inclined in a shape expanding from the rear side to the front side in the optical axis direction, and the front end part is a (first) outgoing opening 37 when the common main body part 15 is used as the first floodlight. A (first) attachment reception part 38 to which the cover part 26 is fitted is formed to expand outward like a flange at the front end part of the side wall part 32 surrounding the whole circumference of the outgoing opening 37. Besides, a (first) attachment seat part 39 for attaching and fixing the cover part 26 is protrudingly provided at the outer edge part of the attachment reception part 38, that is, the front end part of each of the side parts 32*a* of the side wall part 32. A screw hole 39*a* for screwing and fixing a screw or the like as a not-shown fixing body to fix the cover part 26 is opened in the attachment seat part 39. The attachment reception part 38 and the attachment seat part 39 constitute an attachment part 40 for attaching the cover part 26 to the thermal radiator 21 (common main body part 15).

The boss parts 33 are for fixing the reflectors 23 to the thermal radiator 21. The boss parts 33 include a peripheral edge side boss part 41 as one boss part positioned in the vicinity of the inside of each of the side parts 32*a* of the side wall part 32 and center side boss parts 42 as the other boss parts positioned to be separate from each other in the vicinity of the center of the bottom part 31.

The front end part of the peripheral edge side boss part 41 is positioned at a rear side relative to the front end part of the side wall part 32 and the cover part 26 when viewed from the side surface. Besides, the peripheral edge side boss part 41 is formed in an oval shape when viewed from the front side in the optical axis direction. One side thereof is positioned in the vicinity of the center part of each of the side parts 32*a* of the side wall part 32, and the other side extends in a direction inclined with respect to a direction from each of the side parts 32*a* of the side wall part 32 to the center of the bottom part 31. Screw holes 41*a* and 41*b* for fixing the reflector 23 are opened at one side and the other side of the front end part of the peripheral edge side boss part 41.

The center side boss part 42 is formed in a cylindrical shape, and the front end part is positioned at a rear side relative to the front end part of the side wall part 32 and the cover part 26 when viewed from the side surface. Further, the center side boss parts 42 are positioned at the opposite sides with respect to the center of the bottom part 31 and are separated from each other at substantially equal intervals. Screw holes 42*a* for fixing the reflector 23 are opened in the front end parts of the center side boss parts 42.

The respective thermal radiation fins 34 are continuously formed in longitudinal shapes along an up-and-down direction, that is, a direction crossing (orthogonal) to the optical axis direction on the back of the whole bottom part 31 except for the wiring boss part 36 and the lower position thereof, and are separated from each other at a specified interval (interval of, for example, about 6 to 10 mm) in the width direction. Accordingly, passage parts 44 along which air passes are respectively formed between the respective thermal radiation fins 34 and 34. Since the wiring boss part 36 is connected to the power supply part 25, the thermal radiation fins 34 are separated from the power supply part 25 in the optical axis direction and face it. Thus, a space part 45 communicating with the respective passage parts 44 is formed between the power supply part 25 and the respective thermal radiation fins 34.

In each of the light-emitting parts 22, for example, an LED element 22*a* of a solid light-emitting element (semiconductor light-emitting element) is used as a light source. In this embodiment, a COB (Chip On Board) system is adopted in which the plural LED elements 22*a* are mounted on a circular board 22*b*. That is, in each of the light-emitting parts 22, the plural LED elements 22*a* mounted on the board 22*b* are electrically connected in series by wire bonding, and the plural LED elements 22*a* are integrally covered and sealed with a phosphor layer of transparent resin, such as, for example, silicone resin, mixed with phosphor. Incidentally, a lens for luminous intensity distribution may be arranged in the light-emitting part 22. Besides, as the light-emitting part 22, a system may be adopted in which plural SMD (Surface Mount Device) packages mounted with the LED elements 22*a* and having connection terminals are mounted on the board.

Each of the reflectors 23 can be called a middle or wide angle mirror, has a cylindrical shape with open front and rear ends, and is formed in a paraboloidal shape gradually expanding from the rear side to the front side. The inner surface thereof, that is, the reflecting surface is a mirror surface. Further, a flange part 23*a* as a positioning part and as a reflector attachment part is protrudingly provided like a flange on the front end part of the reflector 23 over the whole circumference. Through holes 23*b* and 23*b* for screwing and fixing to the screw holes 41*a* and 41*b* of the peripheral edge side boss parts 41 and 41 or the screw holes 42*a* and 42*a* of the center side boss parts 42 and 42 by using screws or the like as not-shown fixing members are opened in the flange part 23*a*. The through holes 23*b* and 23*b* are positioned at opposite sides with respect to the center (center axis) of the reflector 23 when viewed from the optical axis direction. The through holes 23*b* and 23*b* are positioned at the screw holes 41*a* and 41*b* or the screw holes 42*a* and 42*a* and are fixed by screws or the like, so that the reflector 23 is fixed to the thermal radiator 21 so as to have the optical axis along a direction substantially orthogonal to the surface direction of the bottom part 31.

The attachment arm 24 is for attaching and fixing the floodlight 11 (common main body part 15) at a specified attachment position and at a specified angle, and is integrally formed of a member having rigidity such as, for example, metal. The attachment arm is formed in a U-shape having a pair of arm parts 24*a* and 24*a* and a coupling part 24*b* to couple the arm parts 24*a* and 24*a*.

The arm parts 24*a* and 24*a* are up and down rotatably (tilt rotatably) supported by axis support parts 32*b* and 32*b* protrudingly provided on the outsides of the side parts 32*a* and 32*a* positioned at both sides of the side wall part 32 of the thermal radiator 21. Besides, a rotation plate 47 is positioned between the one arm 24*a* and the one axis support part 32*b*, and the rotation plate 47 is fixed to the one axis support part 32*b*. A rotation stop plate 48 as a rotation stop body is attached to the one arm part 24*a*. The rotation stop plate 48 is fixed to the one arm part 24*a* in a state where the rotation plate 47 is sandwiched between the rotation stop plate and the one arm part 24*a*, so that the floodlight 11 is fixed at the attachment position in the state where the floodlight is set at the specified rotation angle.

A rotation stand 49 is provided at the center part of the coupling part 24*b*. A circular opening 49*a* for fixing at the specified attachment position through a not-shown bolt or the like is opened in the center part of the rotation stand 49, and the floodlight 11 (common main body part 15) can be rotated right and left (pan rotation) by the rotation stand 49. Further, a long hole-shaped rotation angle regulation hole 49*b* curved in a concentric arc shape is opened outside the opening 49*a*. A not-shown rotation regulator protrudingly provided at the attachment position is inserted in the rotation angle regulation hole 49*b*, and regulates the maximum angle of the right and left rotation of the floodlight 11 (common main body part 15).

The power supply part 25 is constructed into a unit such that plural not-shown power supplies are arranged in matrix in a case body 51 having, for example, a square shape, and supplies specified DC power to the light-emitting part 22.

The cover part 26 includes a cover 53 as a cover part main body made of a member having transparency such as glass and formed in, for example, a hexagonal shape, and a frame body 54 of a hexagonal frame shape to hold an outer edge part of the cover 53. The cover 53 is formed such that the outer edge part is slightly larger than the outgoing opening 37 and is fitted to the attachment reception part 38. The frame body 54 includes a frame main body 54*a* to be fitted to the front end part of the side wall part 32 of the thermal radiator 21, and an attachment piece part 54*c* protruding like a flange to the side from the center part of each of side parts 54*b* of the frame main body 54*a*. A through hole 54*d* which is positioned at the screw hole 39*a* of the attachment seat part 39 and in which a screw or the like is inserted is opened substantially at the center part of the attachment piece part 54*c*.

On the other hand, the adapter part 16 includes an extension reflector 56 to be attached to the front end of the reflector 23, and a tubular frame part 57 which surrounds the periphery of the extension reflector 56 and is attached to the thermal radiator 21 of the common main body part 15. That is, the adapter part 16 is attached to the common main body part 15 so as to extend in the optical axis direction. The adapter part 16 is attached to the common main body part 15 instead of the cover part 26, and an extension cover part 58 is attached to the frame part 57, so that the adapter part, together with the common main body part 15, functions as a second floodlight (narrow angle floodlight) capable of providing narrow angle luminous intensity distribution as a second luminous intensity distribution angle narrower than the first luminous intensity distribution angle.

The extension reflector 56 can be called a narrow angle mirror, has a cylindrical shape opened at both front and rear ends, and is formed in a paraboloidal shape gradually expanding from the rear side to the front side. The inner surface thereof, that is, the reflecting surface is a mirror surface. Here, the inner surface of the extension reflector 56 is formed in a paraboloidal shape continuous with the inner surface of the reflector 23 without a step in the state where the extension reflector is attached to the front end of the reflector 23. That is, the inner surface of each of the extension reflector 56 and the reflector 23 has such a shape that the continuous paraboloidal surface for narrow angle luminous intensity distribution is divided in a longitudinal direction by a parting plane PL having a plane shape along a direction crossing (orthogonal) to the axial direction. Accordingly, the arrangement of the light-emitting part 22 and the reflector 23 of the common main body part 15 is set relative to the arrangement for narrow angle luminous intensity distribution. Further, an extension flange part 56*a* as an extension positioning part and as an extension reflector attachment part is protrudingly provided like a flange at the rear end part of the extension reflector 56 over the whole circumference. Similarly to the flange part 23*a* of the reflector 23, through holes 56*b* and 56*b* for screwing and fixing to the screw holes 41*a* and 41*b* of the peripheral edge side boss parts 41 and 41 or the screw holes 42*a* and 42*a* of the center side boss parts 42 and 42 by using screws or the like are opened in the extension flange part 56*a*. The through holes 56*b* and 56*b* are positioned on the opposite side with respect to the center (center axis) of the extension reflector 56 when viewed from the optical axis direction. The reflector 23 and the extension reflector 56 can be integrally fixed to the boss part 33 by overlapping the flange parts 23*a* and 56*a* and by using a screw or the like as a common fixing member.

Besides, the frame part 57 is made of a light weight member of, for example, aluminum, aluminum die casting or synthetic resin and is formed in a hexagonal tubular shape having an axial direction along the optical axis direction, and is separate from, for example, the extension reflector 56. The frame part 57 is formed in a longer shape in the optical axis direction than the extension reflector 56. Accordingly, the front end part of the frame part 57 is positioned in front of the front end part of the extension reflector 56. Further, the frame part 57 gradually expands from the rear side to the front side. A fitting part 61 to be fitted to the attachment reception part 38 is recessed like a step in the rear end part of the frame part 57, and an attachment protrusion part 62 as an adapter attachment part is protrudingly provided at the rear end part of each of side parts 57*a*. A through hole 62*a* which is positioned at the screw hole 39*a* of the attachment seat part 39 of the thermal radiator 21 and in which a screw or the like is inserted is opened in the attachment protrusion part 62. Accordingly, the frame part 57 (adapter part 16) is attachably and detachably attached to the thermal radiator 21 by the attachment part 40 for fixing the cover part 26. In other words, the attachment part 40 is the common attachment part when the cover part 26 and the adapter part 16 are attached to the thermal radiator 21. Besides, the front end part of the frame part 57 is a (second) outgoing opening 64 when the floodlight 11 is used as the second floodlight. A (second) attachment reception part 65 to which the extension cover part 58 is fitted is formed to expand outward like a flange at the front end part of the frame part 57 surrounding the whole circumference of the outgoing opening 64. Besides, a (second) attachment seat part 66 for attaching and fixing the extension cover part 58 is protrudingly provided at the outer edge part of the attachment reception part 65, that is, the front end part of each of the side parts 57*a* of the frame part 57. A screw hole 66*a* for screwing and fixing a screw or the like as a not-shown fixing body to fix the extension cover part 58 is opened in the attachment seat part 66.

Besides, the extension cover part 58 includes an extension cover 71 as an extension cover main body which is made of a member having transparency such as glass and is formed in, for example, a hexagonal plate shape, and an extension frame body 72 having a hexagonal frame shape to hold the outer edge part of the extension cover 71. The extension cover 71 is formed such that the outer edge part is slightly larger than the outgoing opening 64 and is fitted to the attachment reception part 65. Besides, the extension frame body 72 includes an extension frame main body 72*a* to be fitted to the front end part of the frame part 57 and an attachment piece part 72*c* protruding like a flange to a side from the center part of each of side parts 72*b* of the extension frame main body 72*a*. A through hole 72*d* which is positioned at the screw hole 66*a* of the attachment seat part 66 and in which a screw or the like is inserted is opened substantially at the center part of the attachment piece part 72*c*.

Next, the operation of the embodiment will be described.

Figure 2:
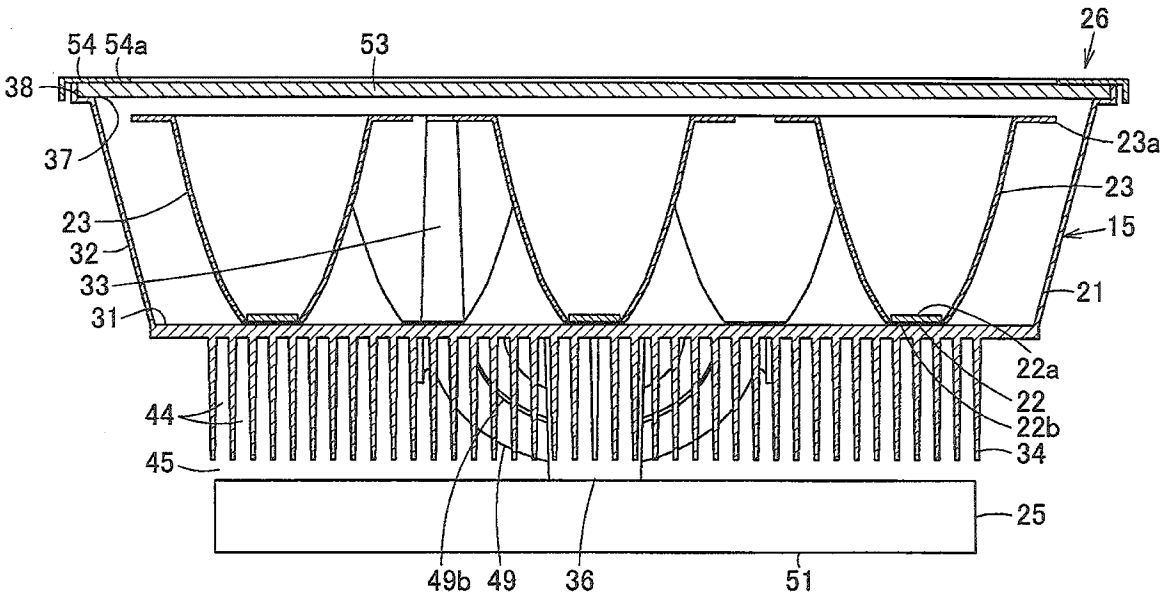
FIG. 2 is a II-II sectional view of FIG. 6 showing the luminaire.
Figure 3:
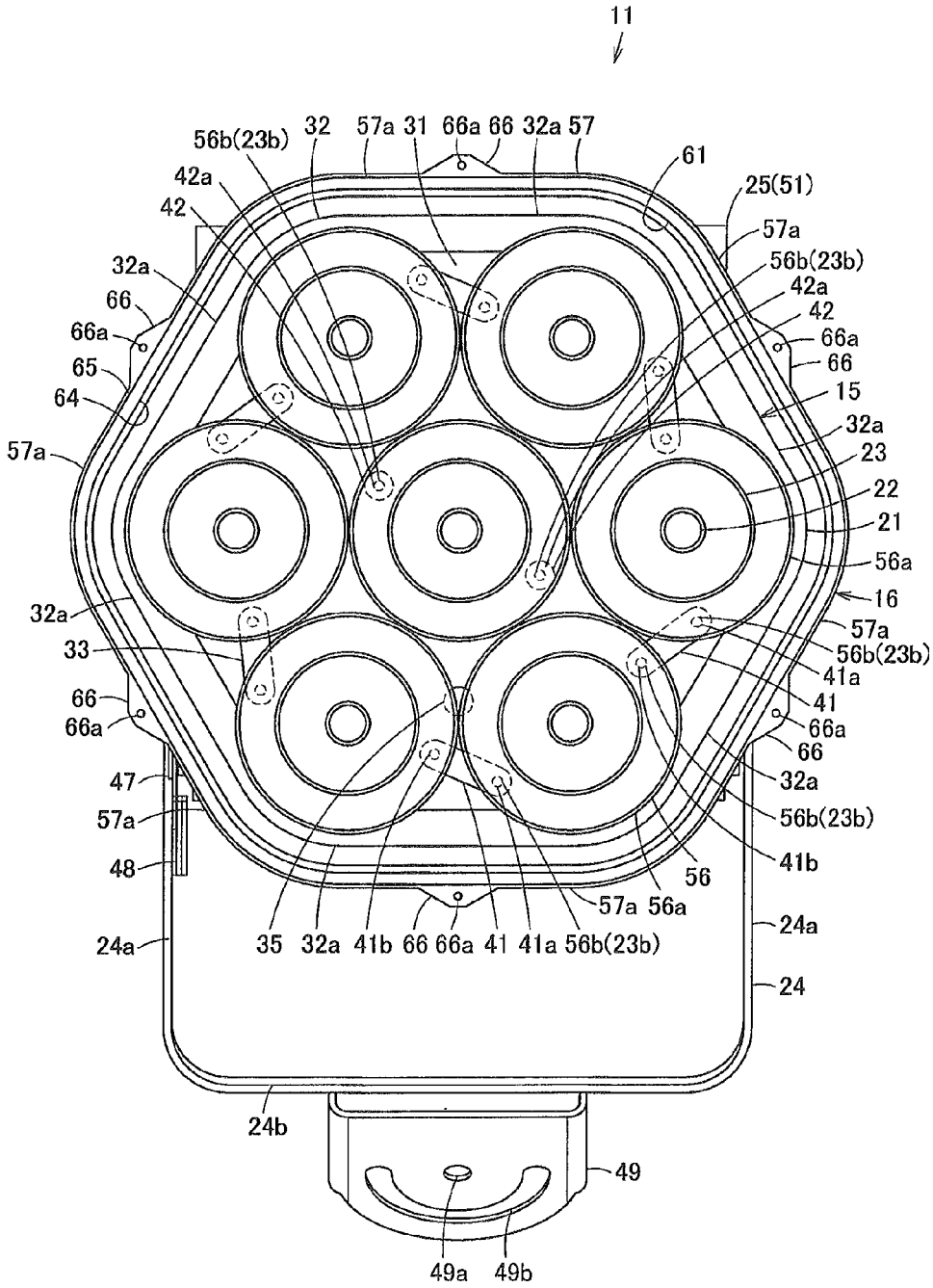
FIG. 3 is a front view showing a state where an extension cover part is removed from a state where the luminaire is used for narrow angle luminous intensity distribution.
Figure 4:
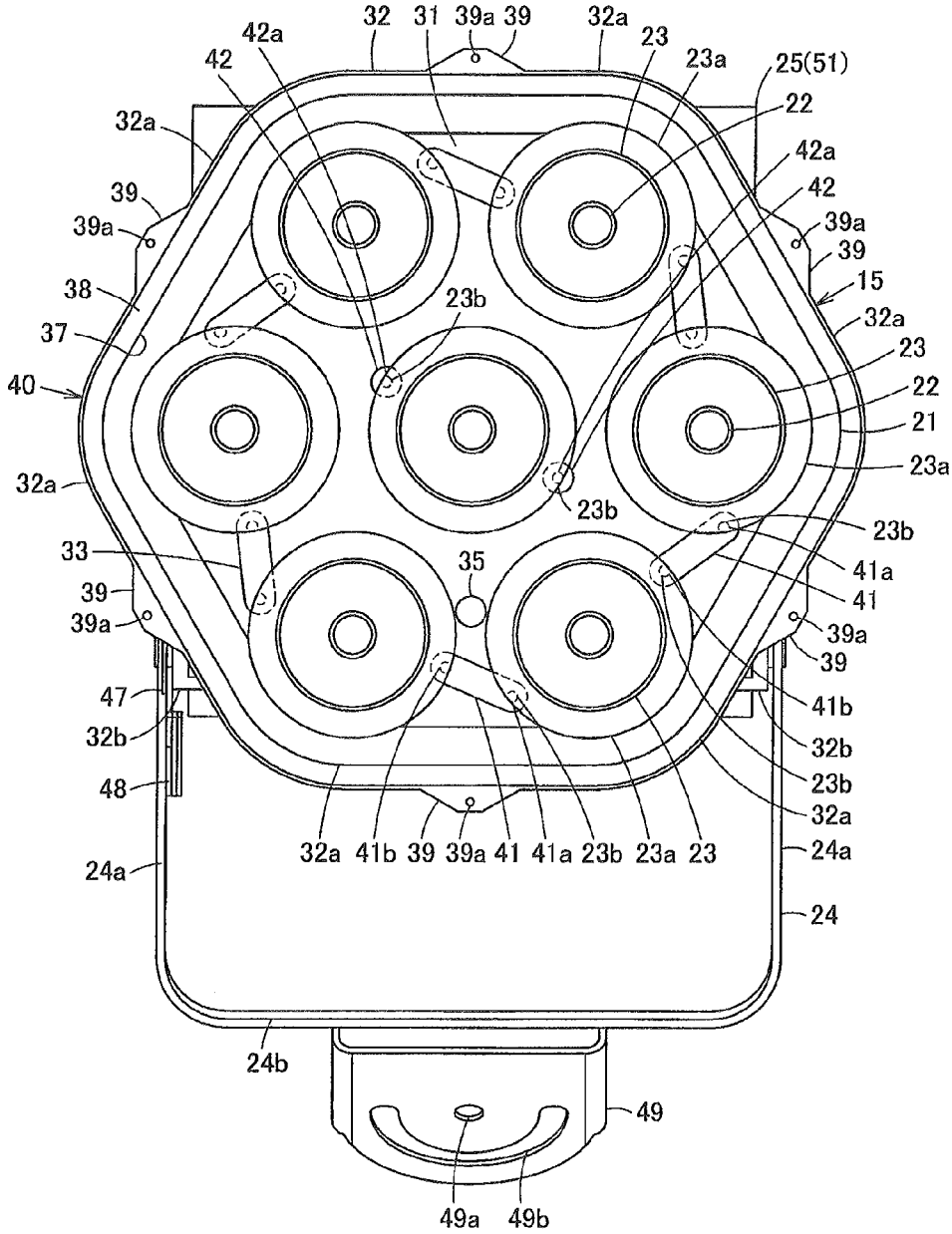
FIG. 4 is a front view showing a state where a cover part is removed from a state where the luminaire is used for middle or wide angle luminous intensity distribution.
Figure 6:
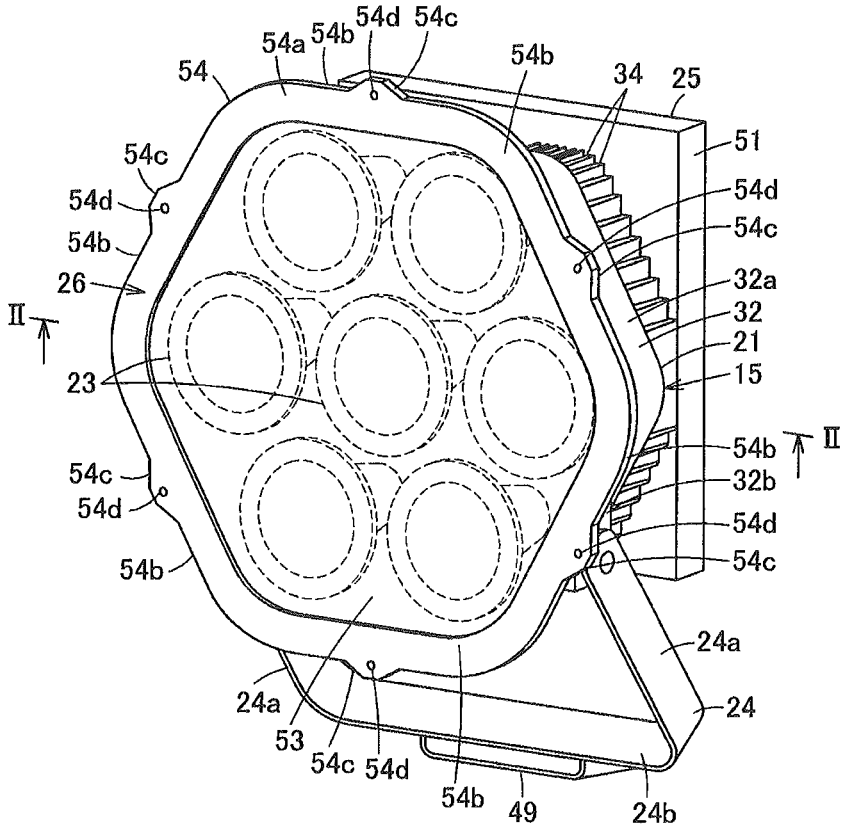
FIG. 6 is a perspective view showing the state where the luminaire is used for middle or wide angle luminous intensity distribution.
Figure 7:
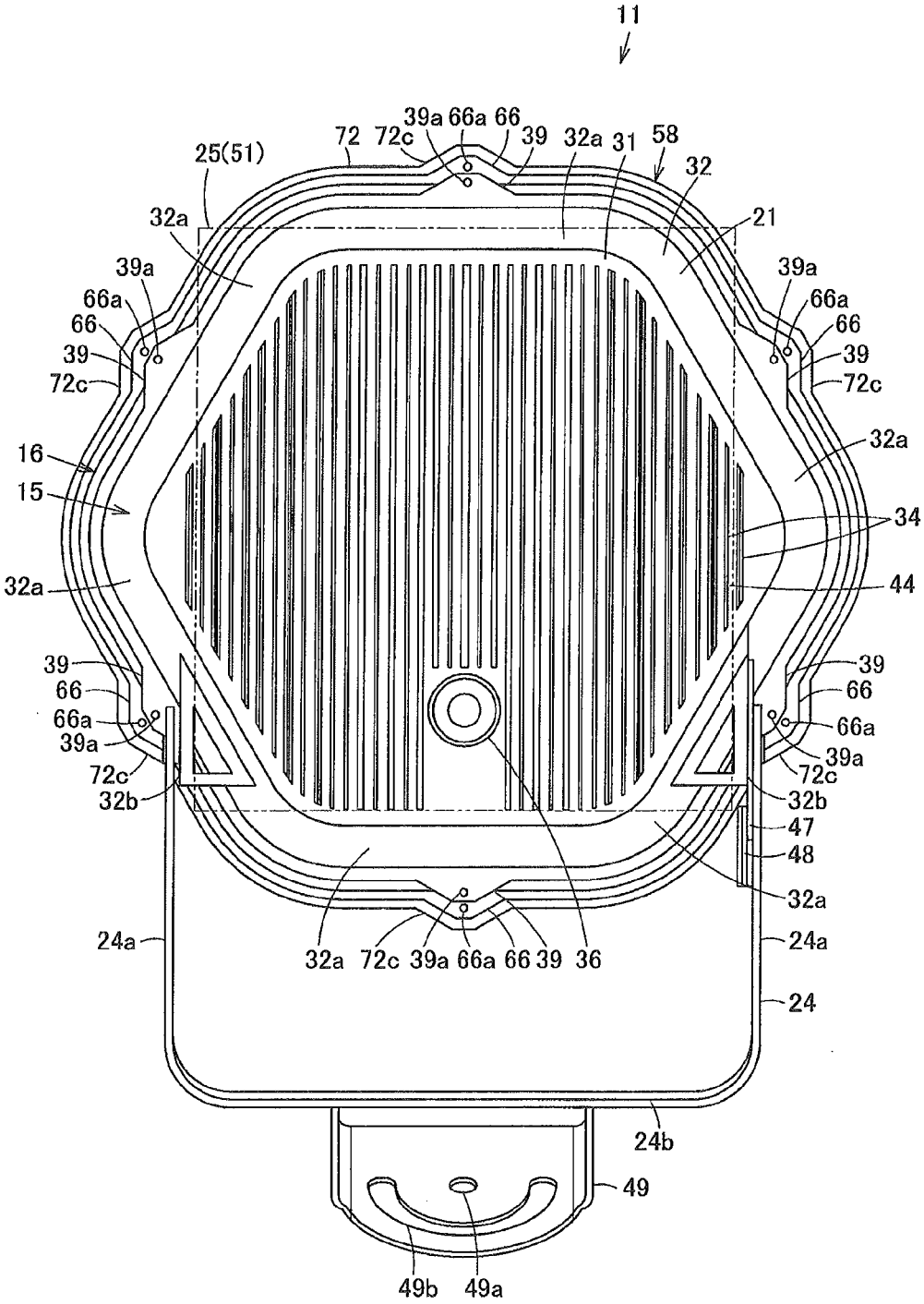
FIG. 7 is a back view showing a thermal radiator of the luminaire.

First, when the floodlight 11 is used for middle angle luminous intensity distribution or wide angle luminous intensity distribution, the adapter part 16 is removed and the cover part 26 is attached to the common main body part 15 (FIG. 2 and FIG. 6).

That is, first, the reflectors 23 are respectively attached to the thermal radiator 21 in which the light-emitting parts 22 are respectively attached and are connected to the power supply part 25. At this time, the reflectors 23 are respectively fixed to the thermal radiator 21 in such a way that the flange parts 23*a* are arranged over the peripheral edge side boss parts 41 and 41 of the boss parts 33 positioned in the vicinity of the inside of the adjacent side parts 32*a* and 32*a* of the side wall part 32 of the thermal radiator 21, the through holes 23*b* and 23*b* are positioned and screwed to the screw holes 41*a* and 41*b* of the peripheral edge side boss parts 41 and 41, and further, the flange parts 23*a* are arranged over the center side boss parts 42 and 42 of the boss parts 33 positioned at the center part side of the thermal radiator 21, and the through holes 23*b* and 23*b* are positioned and screwed to the screw holes 42*a* and 42*a* of the center side boss parts 42 and 42. In this state, center axis positions of the respective reflectors 23 are positioned at the respective light-emitting parts 22, and the light-emitting parts 22 are respectively inserted to the rear end sides.

Next, the cover part 26 is attached to the thermal radiator 21 to which the reflectors 23 are attached. At this time, the cover part 26 is fixed to cover the front end part of the thermal radiator 21 in such a way that the outer edge part of the cover 53 is fitted to the attachment reception part 38 of the thermal radiator 21, and the through holes 54*d* of the respective attachment piece parts 54*c* of the frame body 54 are respectively positioned and screwed to the screw holes 39*a* of the respective attachment seat parts 39 of the side wall part 32 of the thermal radiator 21.

The completed floodlight 11 (common main body part 15) is fixed in such a way that the rotation stand 49 of the attachment arm 24 is attached at the attachment position by a bolt or the like, and the rotation angles in the up-and-down direction and right-and-left direction are adjusted by the arm parts 24*a* and 24*a* and the rotation stand 49 relative to the positional relation between an irradiation object and an attachment position.

The respective light-emitting parts 22 to which power is supplied from the power supply part 25 emit lights, and the lights from the light-emitting parts 22 are reflected by the inner surfaces of the respective reflectors 23 to provide middle angle luminous intensity distribution or wide angle luminous intensity distribution, pass through the cover 53 and illuminate the irradiation object.

Figure 5:
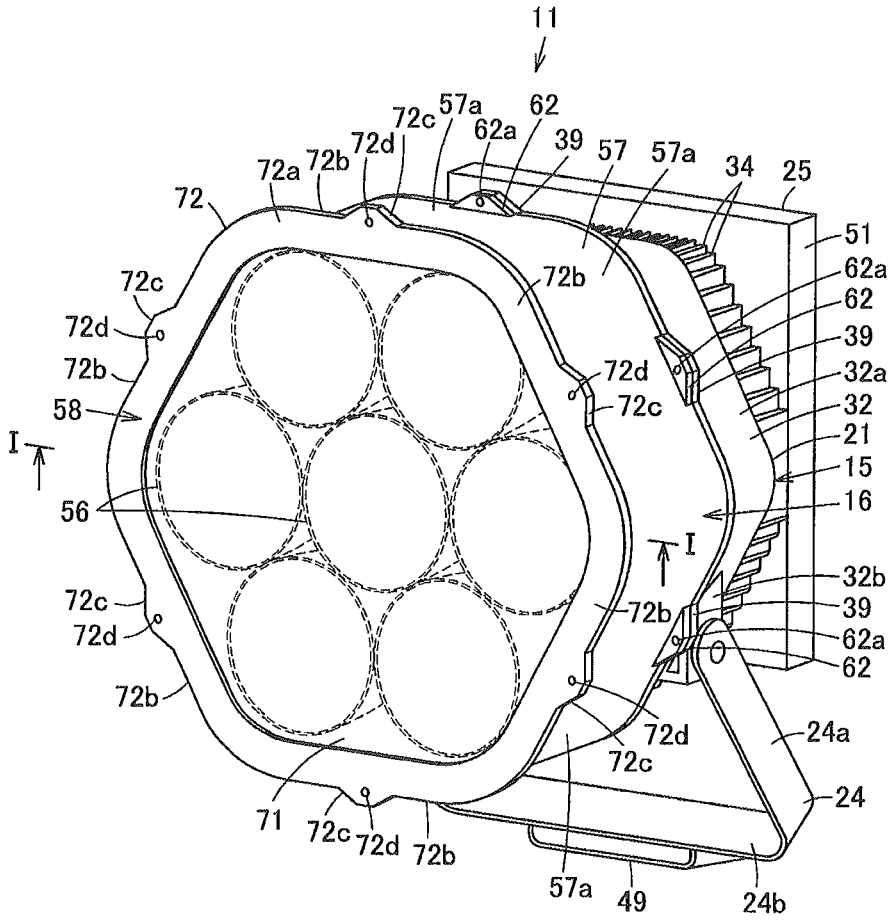
FIG. 5 is a perspective view showing the state where the luminaire is used for narrow angle luminous intensity distribution.

On the other hand, when the floodlight 11 is used for narrow angle luminous intensity distribution, the adapter part 16 is attached to the common main body part 15, and the extension cover part 58 is attached to the adapter part 16 (FIG. 1 and FIG. 5).

That is, first, the extension reflector 56 is attached to the common main body part 15 (in the state where the cover part 26 is removed from the state shown in FIG. 6) in which the respective reflectors 23 are attached to the thermal radiator 21. At this time, the screws screwing the respective reflectors 23 to the boss parts 33 are once removed, the extension flange parts 56*a* of the respective extension reflectors 56 are overlapped with the flange parts 23*a* of the respective reflectors 23, the through holes 56*b* and 56*b*, together with the through holes 23*b* and 23*b*, are positioned at the screw holes 41*a* and 41*b* of the peripheral edge side boss parts 41 and 41 of the boss parts 33, and the reflectors 23 and the extension reflectors 56 are integrally screwed. Further, the through holes 56*b* and 56*b*, together with the through holes 23*b* and 23*b*, are positioned at the screw holes 42*a* and 42*a* of the center side boss parts 42 and 42 of the boss parts 33, and the reflectors 23 and the extension reflectors are integrally screwed. As a result, the respective extension reflectors 56, together with the corresponding reflectors 23, are integrally fixed to the thermal radiator 21. In this state, the center axes of the respective reflectors 23 and the corresponding respective extension reflectors 56 coincide with each other, and the inner surfaces of the respective reflectors 23 and the inner surfaces of the respective extension reflectors 56 are continuous and form paraboloidal surfaces for narrow angle luminous intensity distribution.

Next, the frame part 57 is attached to the thermal radiator 21 of the common main body part 15 to which the extension reflectors 56 are attached. At this time, the fitting part 61 is fitted to the attachment reception part 38, and the through holes 62*a* of the respective attachment protrusion parts 62 are positioned and screwed to the screw holes 39*a* of the respective attachment seat parts 39 of the side wall part 32 of the thermal radiator 21, so that the frame part 57 is fixed to the front end part of the thermal radiator 21 to surround the peripheries of the respective extension reflectors 56 and to hold the extension reflectors 56.

Further, the extension cover part 58 is attached to the frame part 57. At this time, the outer edge part of the extension cover 71 is fitted to the attachment reception part 65 of the frame part 57, and the through holes 72*d* of the respective attachment piece parts 72*c* of the extension frame body 72 are positioned and screwed to the screw holes 66*a* of the respective attachment seat parts 66 of the frame part 57, so that the extension cover part 58 is fixed to cover the front end part of the frame part 57.

The completed floodlight 11 (common main body part 15) is fixed in such a way that the rotation stand 49 of the attachment arm 24 is attached at the attachment position by a bolt or the like, and the rotation angles in the up-and-down direction and right-and-left direction are adjusted by the arm parts 24*a* and 24*a* and the rotation stand 49 relative to the positional relation between the irradiation object and the attachment position.

The respective light-emitting parts 22 to which power is supplied from the power supply part 25 emit lights, and the lights from the light-emitting parts 22 are reflected by the inner surfaces of the respective reflectors 23 and the respective extension reflectors 56 to provide narrow angle luminous intensity distribution, pass through the extension cover 71 and illuminate the irradiation object.

Incidentally, in the thermal radiator 21, the outer air passes along the passage parts 44 and the space part 45 irrespective of the attachment angle of the floodlight 11 (common main body part 15), so that heat generation by the light emission of the light-emitting parts 22 is effectively dissipated from the thermal radiation fins 34.

According to the embodiment described above, the adopter part 16 is provided which is attachable to and detachable from the thermal radiator 21, and includes the extension reflector 56 which is continuous with the reflector 23 in the state where the adopter part is attached to the thermal radiator 21. The extension reflector, together with the reflector 23, controls the luminous intensity distribution from the light-emitting part 22 and provides a luminous intensity distribution angle narrower than the reflector 23. Accordingly, when middle or wide angle luminous intensity distribution is provided, the adopter part 16 is not used, and the distribution can be provided by using the thermal radiator 21 and the reflector 23. When narrow angle luminous intensity distribution is provided, the adapter part 16 is attached to the thermal radiator 21, and the reflector 23 is extended by the extension reflector 56. As a result, while the thermal radiator 21 and the reflector 23 are commonly used for plural different luminous intensity distribution angles (beam angles), that is, while the common structure is used, the different luminous intensity distribution angles can be dealt with. Accordingly, the plural different luminous intensity distribution angles can be dealt with by a smaller number of parts, the convenience is improved, and the cost can be reduced.

Besides, in the floodlight 11, since the thermal radiating structure is required to be designed on the assumption of outdoor use, a forced air cooling structure can not be easily adopted, and it is desirable that a lighting direction can be freely designed to realize up-down-lateral lighting according to the structure of an irradiation object. Then, the thermal radiator 21 is provided with the plural thermal radiation fins 34 which are separated from each other so that air passes between them. Accordingly, a sufficient thermal radiation effect can be obtained irrespective of the attachment direction of the floodlight 11. Besides, also in the light-emitting part 22 using the LED element 22*a*, the light-emitting efficiency is not reduced by heat, and sufficient brightness can be obtained.

Further, the adapter part 16 is attachably and detachably attached to the common main body part 15 (thermal radiator 21) by using the attachment part 40 (attachment reception part 38 and attachment seat part 39) to attach the cover part 26 to the common main body part 15 (thermal radiator 21), that is, the attachment and detachment structures of the adapter part 16 and the cover part 26 to the common main body part 15 (thermal radiator 21) are made common, so that the attachment work of the cover part 26 and the adapter part 16 can be made more efficient.

Besides, since the reflector 23 and the extension reflector 56 can be fixed to the thermal radiator 21 by using the boss part 33 to fix the reflector 23 to the thermal radiator 21, the attachment work of the reflector 23 and the extension reflector 56 can be made more efficient.

As stated above, since many components can be made common to the middle or wide angle case and the narrow angle case, in the floodlight 11, the plural different luminous intensity distribution angles can be dealt with while the cost is reduced by using a smaller number of parts.

Further, since the reflector 23 and the extension reflector 56 are fixed by overlapping the plane circular-shaped flange parts 23*a* and 56*a*, the reflector 23 and the extension reflector 56 can be stably fixed, and a shift between the optical axes of the reflector 23 and the extension reflector 56 and rattling can be reduced.

Further, since the extension reflector 56 and the frame part 57 are made separate from each other, the respective extension reflectors 56 can be attached to the respective reflectors 23 in the state where the frame part 57 does not exist. Accordingly, the working space for the attachment can be sufficiently secured in the surrounding area of the extension reflector 56, and the working property can be more improved.

Incidentally, in the embodiment, the frame part 57 may be constructed so as to integrally hold the extension reflectors 56. In this case, the plural extension reflectors 56 can be easily positioned to the reflectors 23 at one time.

Besides, as long as the extension reflector 56 can be stably fixed to the reflector 23, the extension flange part 56*a* may not be provided. Besides, as long as the flange part 23*a* of the reflector 23 and the extension flange part 56*a* of the extension reflector 56 protrude at positions corresponding to at least the through holes 23*b* and 56*b*, they may not protrude along the whole circumstance.

Further, in addition to the structure in which the reflector 23 and the extension reflector 56 are fixed to the thermal radiator 21 by using the integrally formed flange parts 23*a* and 56*a*, they may be fixed to the thermal radiator 21 by using separate fixing members.

Besides, the thermal radiator 21 may be, for example, radially provided from the center part of the bottom part 31 of the thermal radiator 21.

Further, the solid light-emitting element is not limited to the LED element 22*a*, and for example, an organic EL element or the like may be used.

Besides, although different parts are used as the cover part 26 and the extension cover part 58, the cover part 26 and the extension cover part 58 may be made common to each other in such a way that the frame part 57 is formed to hardly expand from the rear side to the front side, and the cover part 26 is made to be attached to the attachment reception part 65 of the frame part 57 and the attachment seat part 66.

While certain embodiments have been described, these embodiments have been presented by way of example only, and are not intended to limit the scope of the invention. Indeed, the novel systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A luminaire comprising:

at least one light-emitting part;

a thermal radiator thermally coupled to the light-emitting part;

a reflector that is attached to the thermal radiator and shapes luminous intensity distribution of light emitted from the light-emitting part; and an adapter part attached to the thermal radiator and including an extension reflector that is continuous with the reflector and, together with the reflector, shapes the luminous intensity distribution of the light emitted from the light-emitting part to provide a luminous intensity distribution angle narrower than a luminous intensity distribution angle of the reflector without the extension reflector.

2. The luminaire according to claim 1, further comprising:

a translucent cover that covers an open end of the reflector through which the light emitted from the light-emitting part is distributed, wherein the thermal radiator includes an attachment part to which the cover part and the adapter part are attached.

3. The luminaire according to claim 1, wherein the thermal radiator includes a plurality of thermal radiation fins separated from each other to allow air to pass between the fins.

4. The luminaire according to claim 3, wherein the thermal radiator includes a frame having a first surface to which the light-emitting part is attached and is thermally coupled, and the thermal radiation fins are disposed on a second surface of the frame that is opposite to the first surface.

5. The luminaire according to claim 1, wherein the thermal radiator includes a fixing part to which the reflector is attached.

6. The luminaire according to claim 5, wherein the reflector includes a flange part that is fixed to the fixing part, and the extension reflector includes an extension flange part that is overlapped with the flange part fixed to the fixing part.

7. The luminaire according to claim 1, wherein the adapter part includes a frame surrounding a periphery of the extension reflector.

8. The luminaire according to claim 1, wherein the at least one light-emitting part includes an LED element.

9. The luminaire according to claim 1, further comprising an attachment arm that rotatably supports the thermal radiator.

10. A method of assembling a luminaire having at least one light-emitting unit, comprising:

attaching a thermal radiator to the light-emitting unit to thermally couple the thermal radiator to the light-emitting unit;

attaching a reflector to the thermal radiator, the reflector being configured to shape luminous intensity distribution of light emitted from the light-emitting unit; and attaching an extension reflector to the thermal radiator so that the reflector and the extension reflector shape the luminous intensity distribution of the light emitted from the light-emitting unit to provide a luminous intensity distribution angle that is narrower than that of the reflector without the extension reflector.

11. The method of claim 10, further comprising:

covering an open end of the reflector through which the light emitted from the light-emitting unit is distributed with a translucent cover.

12. The method of claim 10, wherein the thermal radiator includes a plurality of thermal radiation fins separated from each other to allow air to pass between the fins.

13. The method of claim 12, wherein the thermal radiator includes a frame having a first surface to which the light-emitting part is attached and is thermally coupled, and the thermal radiation fins are disposed on a second surface of the frame that is opposite to the first surface.

14. The method of claim 10, wherein the thermal radiator includes a fixing part to which the reflector is attached.

15. The method of claim 14, wherein the reflector includes a flange part that is fixed to the fixing part, and the extension reflector includes an extension flange part that is overlapped with the flange part fixed to the fixing part.

16. The method of claim 10, further comprising:

attaching an attachment arm to the thermal radiator to rotatably support the thermal radiator.

* * * * *